US007717503B1

(12) United States Patent
Watson

(10) Patent No.: US 7,717,503 B1
(45) Date of Patent: May 18, 2010

(54) COLLAPSIBLE CHAIR APPARATUS

(76) Inventor: Lisa M. Watson, 1404 Adobe Dr., Pontiac, IL (US) 61764

( * ) Notice: Subject to any disclaimer, the term of this patent is extended or adjusted under 35 U.S.C. 154(b) by 0 days.

(21) Appl. No.: 12/268,629

(22) Filed: Nov. 11, 2008

(51) Int. Cl.
*A47C 4/00* (2006.01)

(52) U.S. Cl. ..... 297/45; 297/16.2; 297/42

(58) Field of Classification Search ..... 297/16.1–16.2, 297/17–60; D6/334–336, 368
See application file for complete search history.

(56) References Cited

U.S. PATENT DOCUMENTS

| | | | | |
|---|---|---|---|---|
| 2,820,509 | A | 1/1958 | Moreland | |
| 4,826,241 | A | 5/1989 | Barras | |
| 5,303,975 | A * | 4/1994 | Asato | 297/129 |
| 6,036,262 | A | 3/2000 | Shahid | |
| 6,045,177 | A * | 4/2000 | Grace | 297/45 |
| 6,082,813 | A * | 7/2000 | Chen | 297/16.2 |
| 6,247,749 | B1 * | 6/2001 | Yu | 297/16.2 |
| 6,247,750 | B1 * | 6/2001 | Tsai | 297/16.2 |
| 6,264,078 | B1 | 7/2001 | Bilang | |
| 6,264,271 | B1 * | 7/2001 | Munn et al. | 297/45 |
| 6,601,912 | B1 * | 8/2003 | Chen | 297/45 |
| 6,752,414 | B1 * | 6/2004 | Waldron et al. | 280/649 |
| 6,871,905 | B2 * | 3/2005 | Grace | 297/16.2 |
| 6,899,383 | B2 * | 5/2005 | Hwang | 297/16.2 |
| 6,926,355 | B2 * | 8/2005 | Le Gette et al. | 297/16.2 |
| D522,263 | S | 6/2006 | Hart | |
| 7,348,097 | B2 * | 3/2008 | Nielsen et al. | 429/180 |

* cited by examiner

*Primary Examiner*—David Dunn
*Assistant Examiner*—Erika Garrett

(57) ABSTRACT

A collapsible chair apparatus includes a frame having a plurality of legs and braces attached to and extending between the legs. The legs are positionable in a stored position positioned adjacent to each other or in a deployed position spaced from each other. A first panel is attached to the legs to define a seat member. A pair of back supports is attached to and extends upwardly from the plurality of legs. The back supports are positioned adjacent to each other when the legs are in the stored position and are spaced from each other when the legs are in the deployed position. A second panel extends between the back supports. A lower securing strap has a first end attached to one of the back legs and is extended around the plurality of legs and coupled to itself by a securing member when the legs are in the stored position.

8 Claims, 6 Drawing Sheets

COLLAPSIBLE CHAIR APPARATUS

BACKGROUND OF THE INVENTION

Field of the Invention

The present invention relates to portable chair devices and more particularly pertains to a new portable chair device for providing an easily transportable and collapsible chair upon which a person may sit.

SUMMARY OF THE INVENTION

The present invention meets the needs presented above by generally comprising a frame that includes a plurality of legs. A plurality of braces is attached to and extends between pairs of the legs. The braces are hingedly coupled to the legs to allow the legs to be placed in a stored position positioned adjacent to each other or in a deployed position spaced from each other. Each of the legs has an upper end. A first panel is attached to the upper ends and defines a seat member for sitting upon when the legs are in the deployed position. Two of the legs define back legs. A pair of back supports is attached to and extends upwardly from the back legs. The back supports are positioned adjacent to each other when the legs are in the stored position and are spaced from each other when the legs are in the deployed position. A second panel is attached to and extends between the back supports to define a backrest. A lower securing strap has a first end and a second end. The first end of the lower securing strap is attached to one of the back legs. The lower securing strap is extended around the plurality of legs and coupled to itself by a securing member when the legs are in the stored position to releasably retain the legs in the stored position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
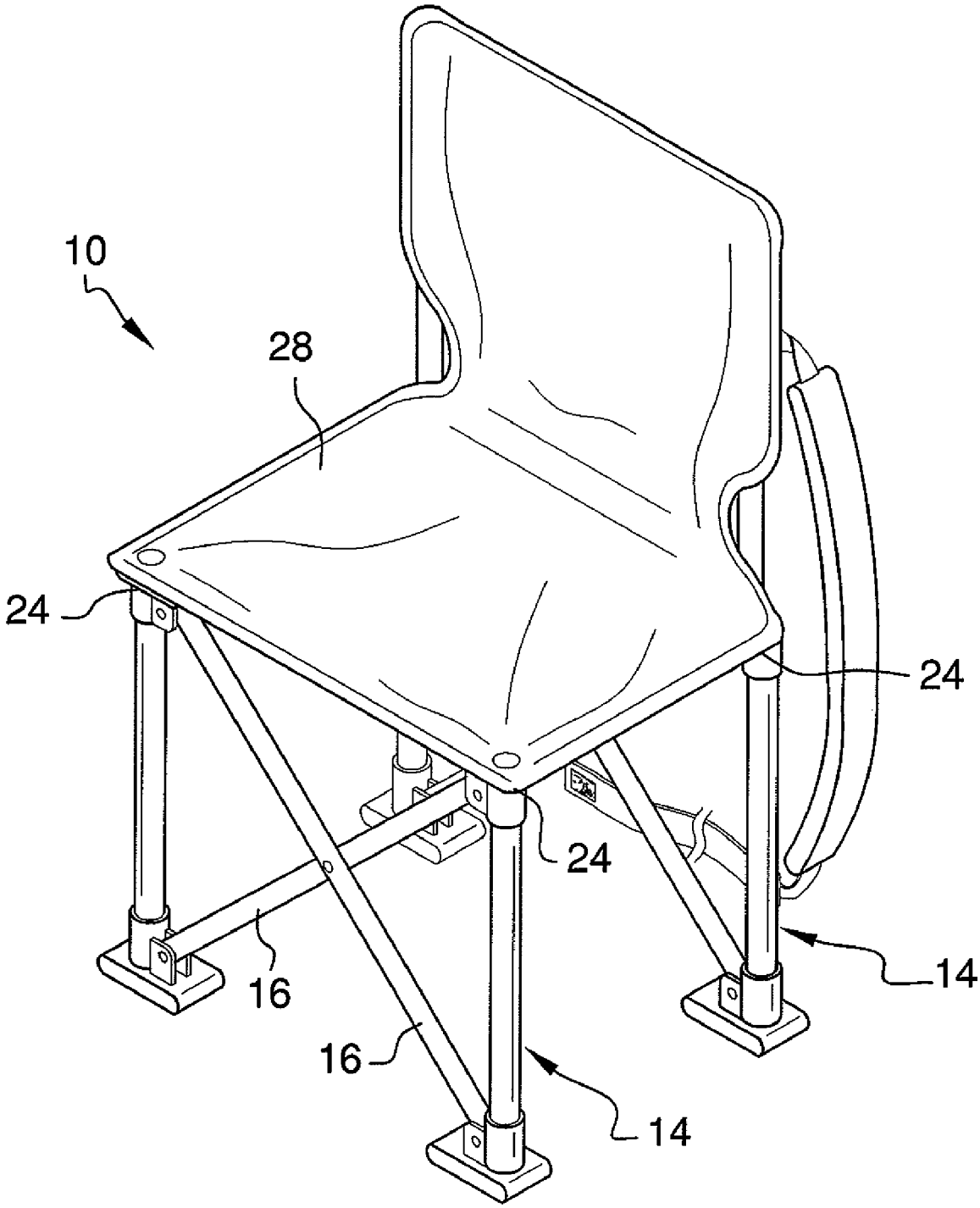
FIG. 1 is a front perspective view of a collapsible chair apparatus according to the present invention.
Figure 2:
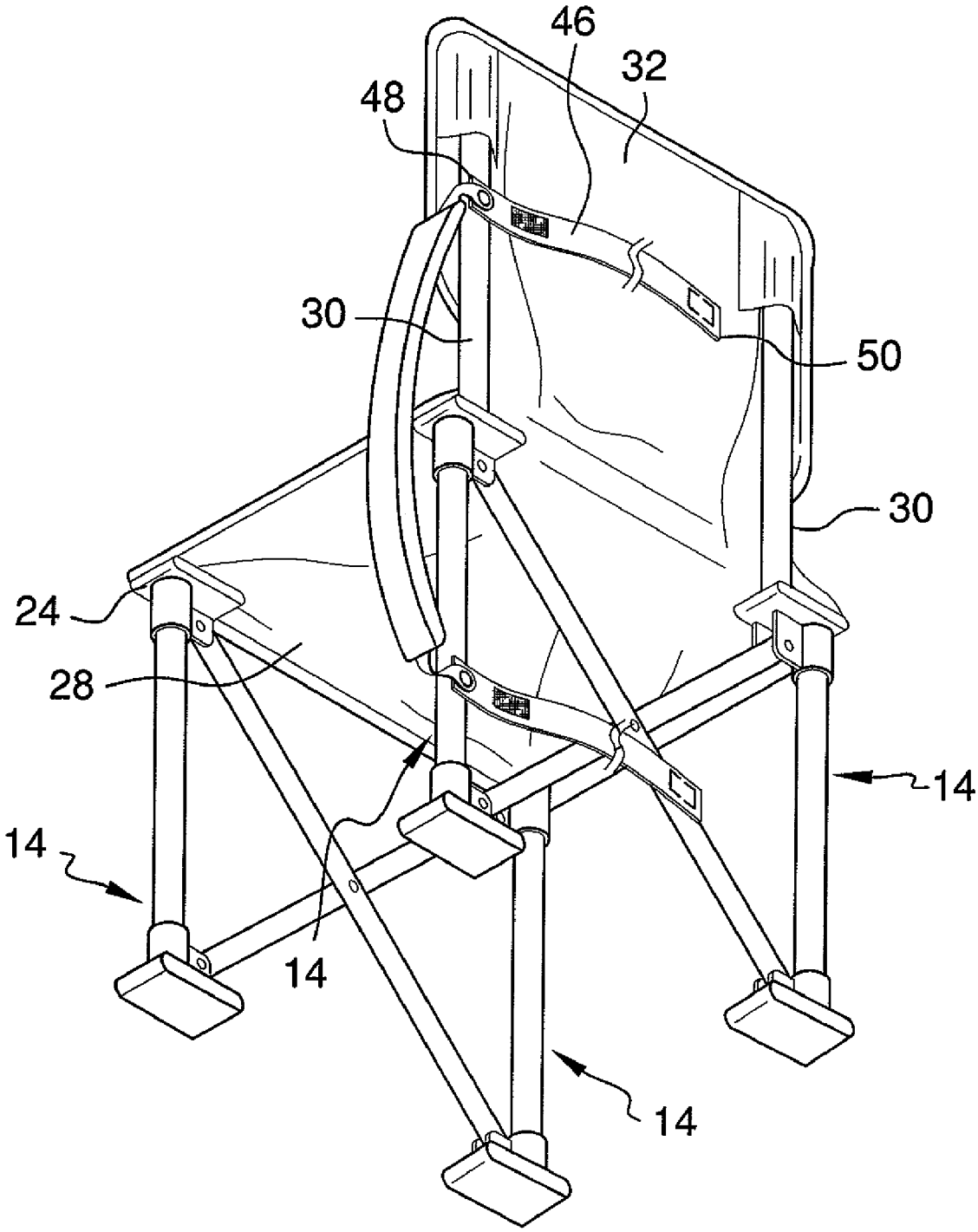
FIG. 2 is a rear bottom perspective view of the present invention.
Figure 3:
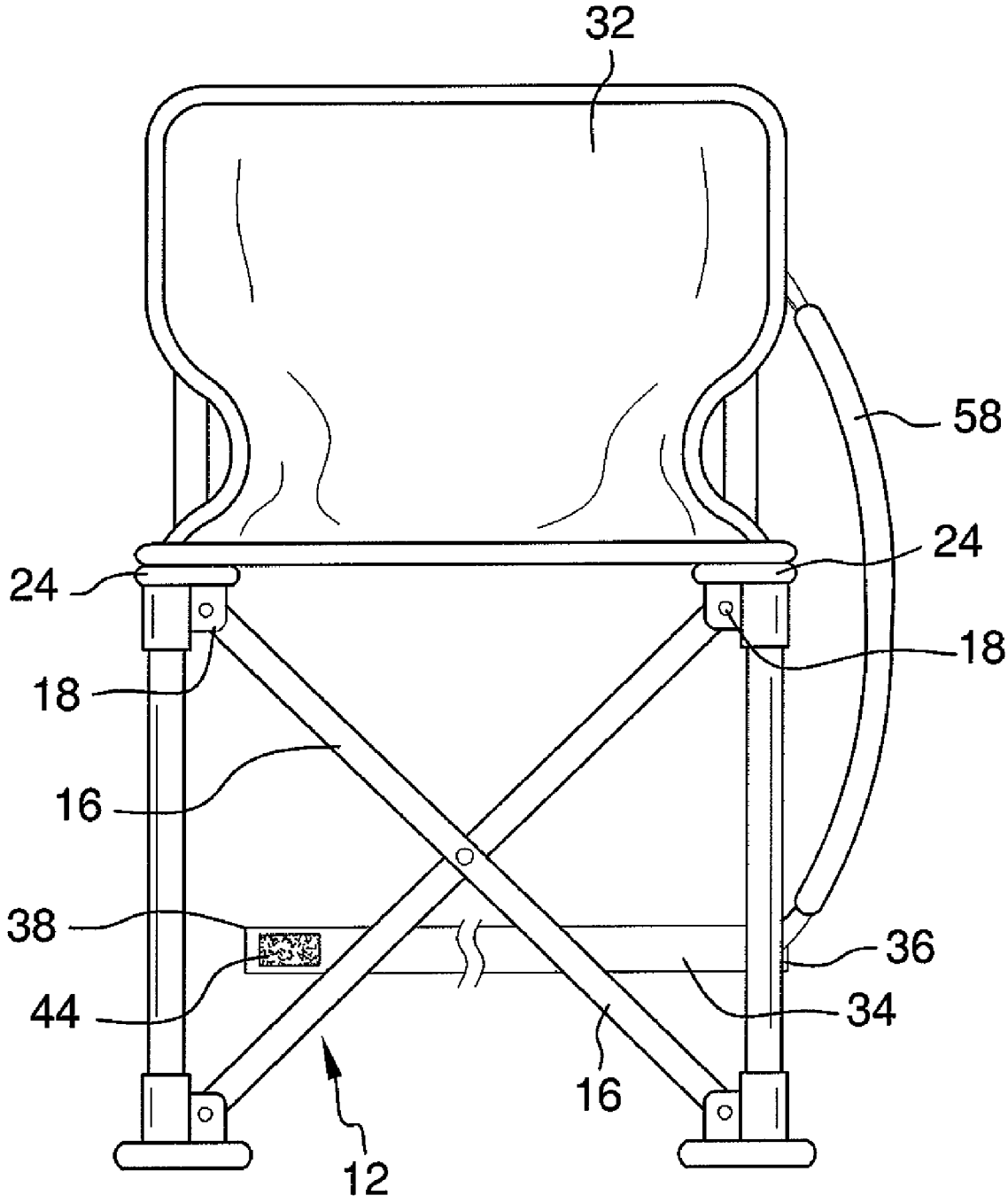
FIG. 3 is a front view of the present invention.
Figure 4:
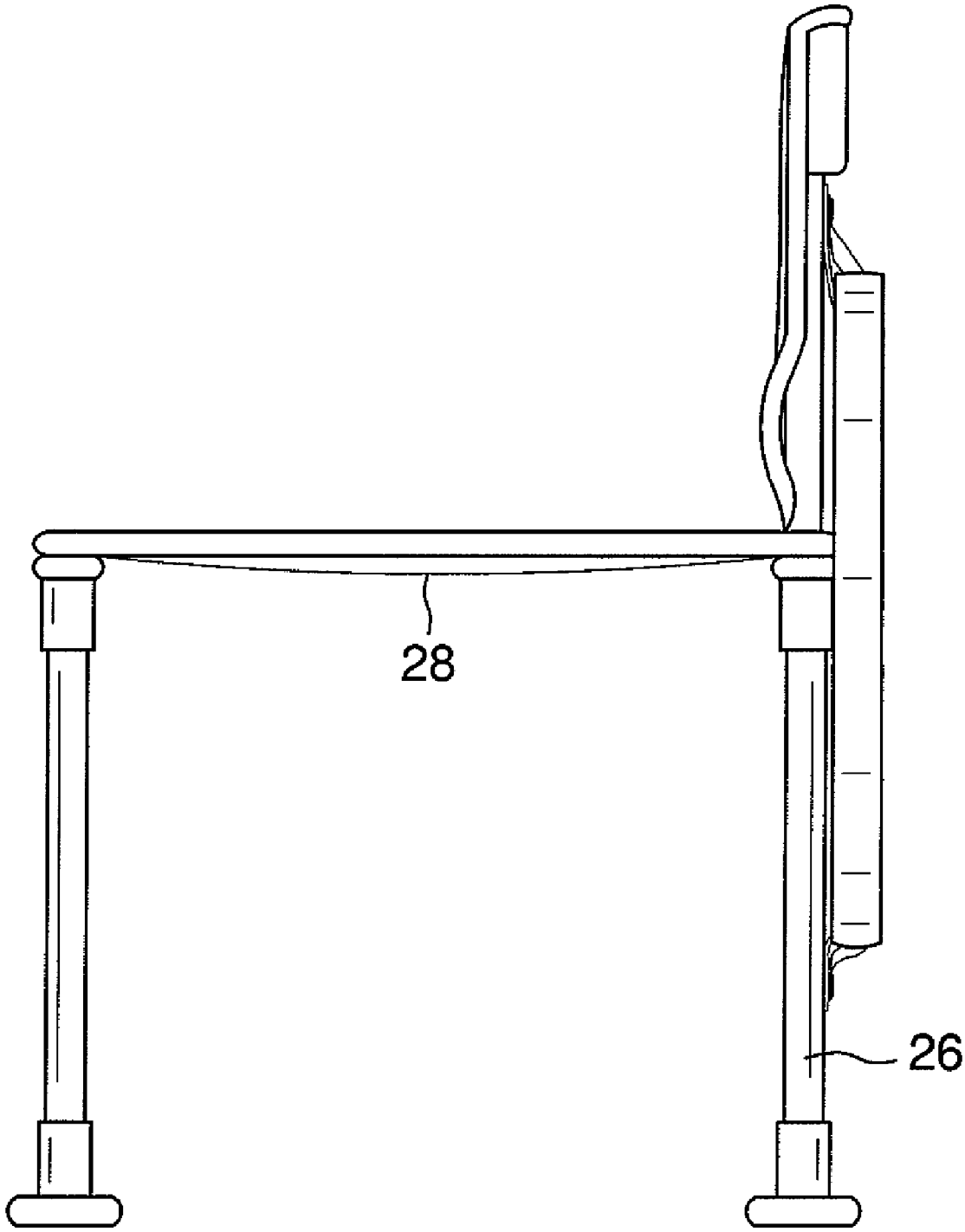
FIG. 4 is a side view of the present invention.
Figure 5:
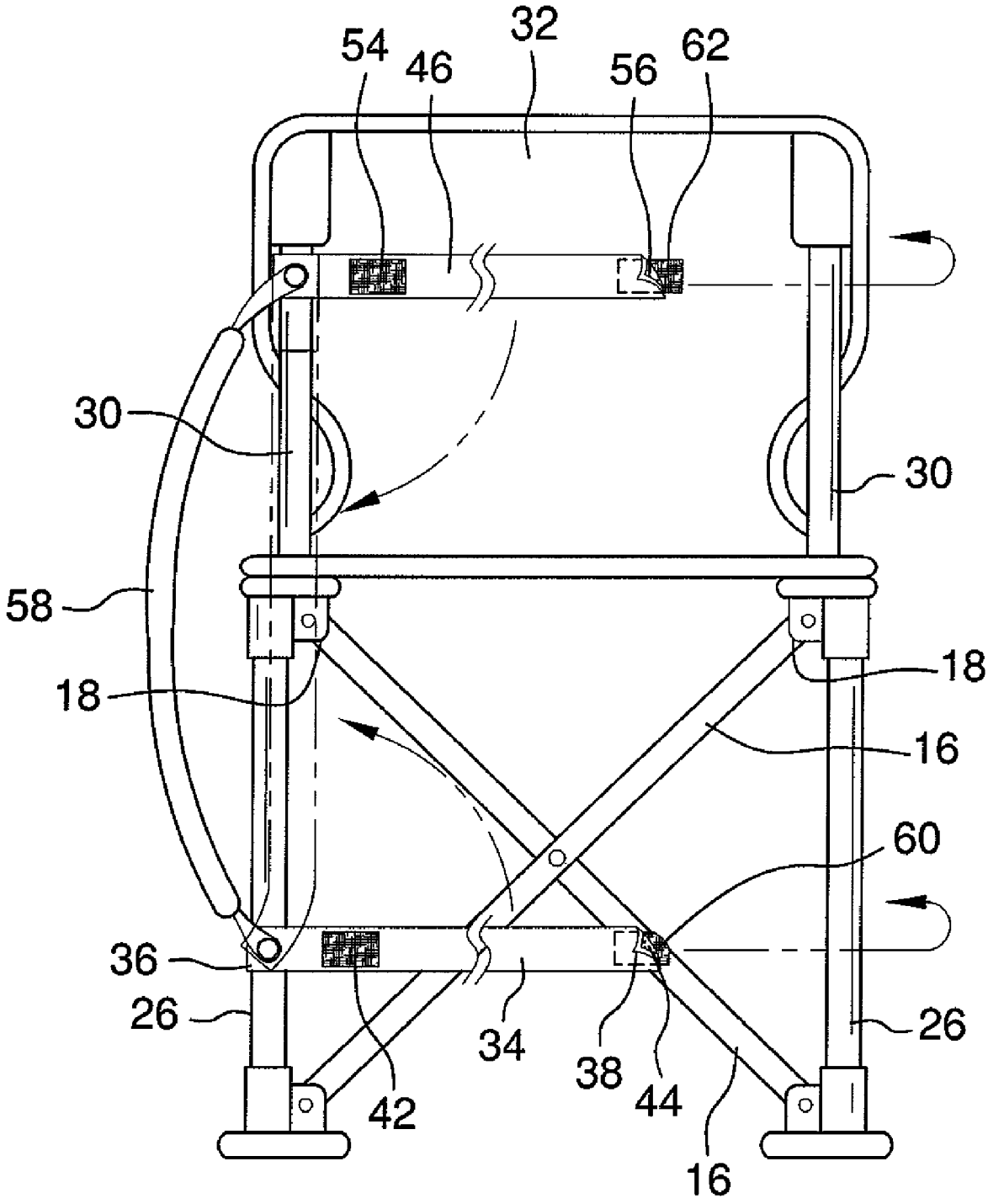
FIG. 5 is a rear view of the present invention.

With reference now to the drawings, and in particular to FIGS. 1 through 6 thereof, a new portable chair device embodying the principles and concepts of the present invention and generally designated by the reference numeral 10 will be described.

Figure 6:
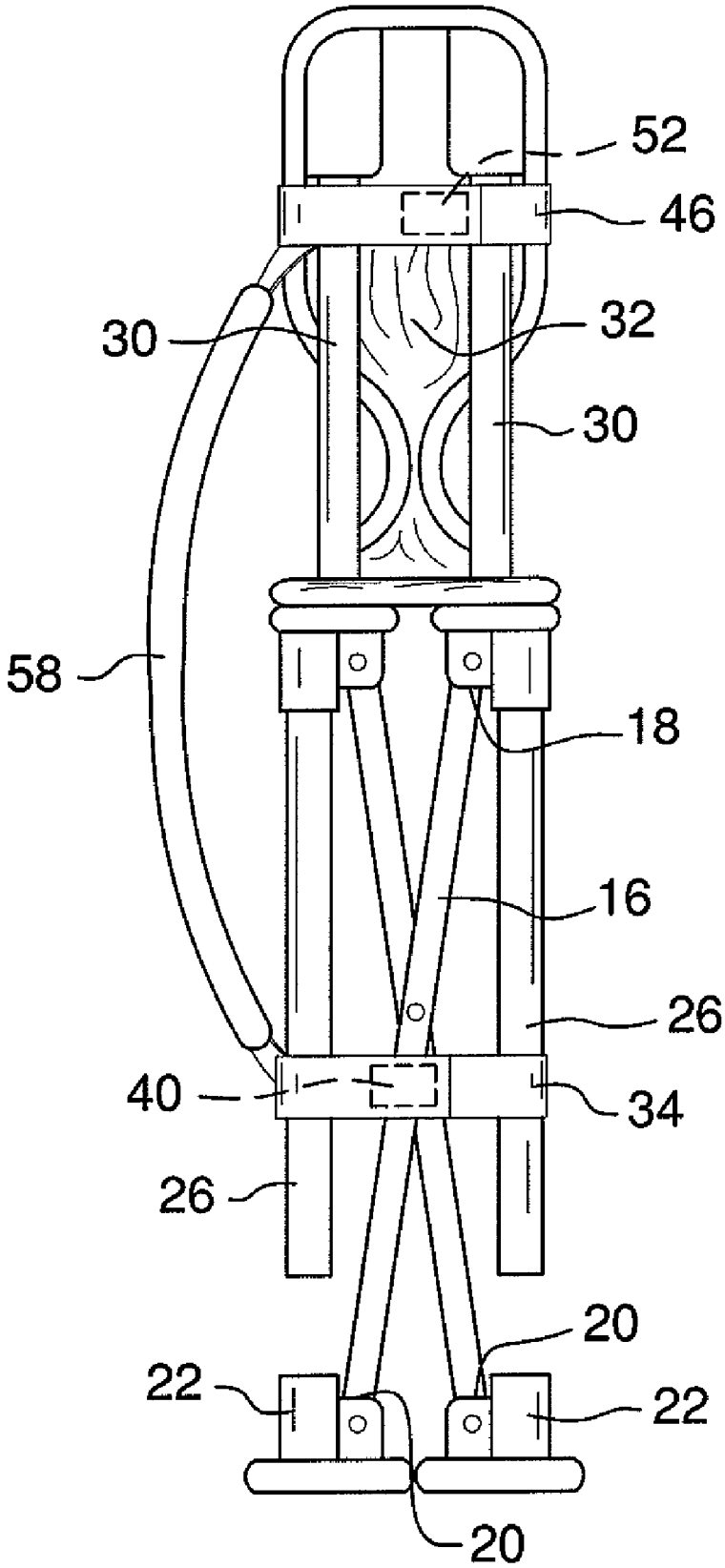
FIG. 6 is a rear view of the present invention in a stored position.

As best illustrated in FIGS. 1 through 6, the collapsible chair apparatus 10 generally comprises a frame 12 including a plurality of legs 14. A plurality of braces 16 is attached to and extends between pairs of the legs 14. The braces 16 are hingedly coupled to the legs 14 to allow the legs 14 to be placed in a stored position positioned adjacent to each other or in a deployed position spaced from each other. The braces 16 each include a hinged end 18 and non-hinged end 20 that may be slidably coupled to one of the legs 14 or may be removable from the legs 14 when the legs 14 are placed in the stored position. FIG. 6 depicts a version wherein the braces 16 are attached to sleeves 22 that are removable, though any conventional structure allowing the legs 14 to be collapsed against each other will generally be sufficient. Each of the legs 14 has an upper end 24. Two of the legs 14 define back legs 26. A first panel 28 is attached to the upper ends 24 and defines a seat member for sitting upon when the legs 14 are in the deployed position. The first panel 28 is comprised of a flexible material, such as a natural or synthetic cloth material.

A pair of back supports 30 is attached to and extends upwardly from the back legs 26. The back supports 30 are positioned adjacent to each other when the legs 14 are in the stored position and are spaced from each other when the legs 14 are in the deployed position. The back supports 30 may be extensions of the back legs 26. A second panel 32 is attached to and extends between the back supports 30 to define a backrest. The second panel 32 is comprised of a flexible material, such as a natural or synthetic cloth material. The second panel 32 is integrally coupled to the first panel 28.

A lower securing strap 34 has a first end 36 and a second end 38. The first end 36 of the lower securing strap 34 is attached to one of the back legs 26 and the lower securing strap 34 is extended around the plurality of legs 14 and coupled to itself by a securing member 40 when the legs 14 are in the stored position to releasably retain the legs 14 in the stored position. The securing member 40 may comprise a snap or a hook and loop securing member that includes a first mating member 42 attached to the lower securing strap 34 nearer to the first end 36 than the second end 38 and a second mating member 44 attached to the lower securing strap 34 nearer to the second end 38 than the first end 32.

An upper securing strap 46 has a first end 48 and a second end 50. The first end 48 of the upper securing strap 46 is attached to one of the back supports 30 and the upper securing strap 46 is extended around each of the back supports 30 and coupled to itself by a securing member 52 when the legs 14 are in the stored position. The securing member 52 of the upper securing strap 46 may comprise a snap or a hook and loop securing member including a first mating member 54 attached to the upper securing strap 46 nearer to the first end 48 than the second end 50 and a second mating member 56 attached to the upper securing strap 46 nearer to the second end 50 than the first end 48.

A carrying strap 58 is attached to and extends between one of the back legs 26 and an adjacent one of the back supports 30. The carrying strap 58 is accessible to carry the apparatus 10 when the legs 14 are in the stored position. The carrying strap 58 has a length of at least 24 inches and allows the apparatus 10 to be slung over a person's shoulder. The carrying strap 58 may be comprised of a resiliently compressible material.

A lower auxiliary mating member 60 is attached to the frame 12 and engages the second mating member 44 on the lower securing strap 34 when the legs 14 are in the deployed position. An upper auxiliary mating 62 member is attached to the second panel 32 and engages the second mating member 56 on the upper securing strap 46 when the legs 14 are in the deployed position. The lower 60 and upper 62 auxiliary mating members prevent the lower 34 and upper 46 securing straps from touching the ground when the legs 14 are in the deployed position.

In use, when the legs 14 are deployed, the apparatus 10 is used as a conventional chair. However, when the legs 14 are in the stored position, the carrying strap 58 as well as the lower 34 and upper 46 securing straps allow for a very easy to transport and each to store collapsible chair.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible chair apparatus comprising:

a frame including a plurality of legs, a plurality of braces being attached to and extending between pairs of said legs, said braces being hingedly coupled to said legs to allow said legs to be placed in a stored position positioned adjacent to each other or in a deployed position spaced from each other, each of said legs having an upper end, a first panel being attached to said upper ends and defining a seat member for sitting upon when said legs are in said deployed position, two of said legs defining back legs;

a pair of back supports being attached to and extending upwardly from said back legs, said back supports being positioned adjacent to each other when said legs are in said stored position and being spaced from each other when said legs are in said deployed position, a second panel being attached to and extending between said back supports to define a backrest; and a lower securing strap having a first end and a second end, said first end of said lower securing strap being attached to one of said back legs, said lower securing strap being extended around said plurality of legs and coupled to itself by a securing member when said legs are in said stored position to releasably retain said legs in said stored position;

said securing member including a first mating member attached to said lower securing strap nearer to said first end than said second end and a second mating member attached to said lower securing strap nearer to said second end than said first end; and a lower auxiliary mating member being attached to said frame and engaging said second mating member on said lower securing strap when said legs are in said deployed position.

2. The apparatus according to claim 1, wherein said securing member comprises a hook and loop securing member.

3. The apparatus according to claim 1, further including an upper securing strap having a first end and a second end, said first end of said upper securing strap being attached to one of said back supports, said upper securing strap being extended around each of said back supports and coupled to itself by a securing member when said legs are in said stored position.

4. The apparatus according to claim 3, wherein said securing member of said upper securing strap comprising a hook and loop securing member including a first mating member attached to said upper securing strap nearer to said first end than said second end and a second mating member attached to said upper securing strap nearer to said second end than said first end.

5. The apparatus according to claim 4, further including an upper auxiliary mating member being attached to said second panel and engaging said second mating member on said upper securing strap when said legs are in said deployed position.

6. The apparatus according to claim 1, further including a carrying strap being attached to and extending between one of said back legs and an adjacent one of said back supports, said carrying strap being accessible to carry said apparatus when said legs are in said stored position.

7. The apparatus according to claim 1, further including:

a carrying strap being attached to and extending between one of said back legs and an adjacent one of said back supports, said carrying strap being accessible to carry said apparatus when said legs are in said stored position; and a lower auxiliary mating member being attached to said frame and engaging said second mating member on said lower securing strap when said legs are in said deployed position.

8. A collapsible chair apparatus comprising:

a frame including a plurality of legs, a plurality of braces being attached to and extending between pairs of said legs, said braces being hingedly coupled to said legs to allow said legs to be placed in a stored position positioned adjacent to each other or in a deployed position spaced from each other, each of said legs having an upper end, a first panel being attached to said upper ends and defining a seat member for sitting upon when said legs are in said deployed position, two of said legs defining back legs;

a pair of back supports being attached to and extending upwardly from said back legs, said back supports being positioned adjacent to each other when said legs are in said stored position and being spaced from each other when said legs are in said deployed position, a second panel being attached to and extending between said back supports to define a backrest, said second panel being integrally coupled to said first panel;

a lower securing strap having a first end and a second end, said first end of said lower securing strap being attached to one of said back legs, said lower securing strap being extended around said plurality of legs and coupled to itself by a securing member when said legs are in said stored position to releasably retain said legs in said stored position, said securing member comprising a hook and loop securing member including a first mating member attached to said lower securing strap nearer to said first end than said second end and a second mating member attached to said lower securing strap nearer to said second end than said first end;

an upper securing strap having a first end and a second end, said first end of said upper securing strap being attached to one of said back supports, said upper securing strap being extended around each of said back supports and coupled to itself by a securing member when said legs are in said stored position, said securing member of said upper securing strap comprising a hook and loop securing member including a first mating member attached to said upper securing strap nearer to said first end than said second end and a second mating member attached to said upper securing strap nearer to said second end than said first end;

a carrying strap being attached to and extending between one of said back legs and an adjacent one of said back supports, said carrying strap being accessible to carry said apparatus when said legs are in said stored position;

a lower auxiliary mating member being attached to said frame and engaging said second mating member on said lower securing strap when said legs are in said deployed position; and an upper auxiliary mating member being attached to said second panel and engaging said second mating member on said upper securing strap when said legs are in said deployed position.

* * * * *